US005709277A

United States Patent [19]

Geldner

[11] Patent Number: 5,709,277

[45] Date of Patent: Jan. 20, 1998

[54] DIRECTIONAL BORING MACHINE

[76] Inventor: Robert L. Geldner, Rte. 1, Box 199, Cleveland, Minn. 56017

[21] Appl. No.: 499,615

[22] Filed: Jul. 7, 1995

[51] Int. Cl.[6] ..... E21B 19/08

[52] U.S. Cl. ..... 175/203; 175/220; 173/38

[58] Field of Search ..... 175/203, 85, 122, 175/162, 220; 173/38, 147, 185

[56] References Cited

U.S. PATENT DOCUMENTS

| | | | |
|---|---|---|---|
| 3,718,367 | 2/1973 | Schumacher | 299/14 |
| 3,990,522 | 11/1976 | Pyles et al. | 173/78 |
| 4,149,604 | 4/1979 | Lockwood et al. | 175/57 |
| 4,371,041 | 2/1983 | Becker et al. | 173/28 |
| 4,703,811 | 11/1987 | Lam | 173/28 |
| 5,033,554 | 7/1991 | Younes | 175/203 X |
| 5,039,068 | 8/1991 | Venturini et al. | 175/203 X |
| 5,054,565 | 10/1991 | Kinnan | 175/19 |
| 5,158,146 | 10/1992 | Fuller | 175/203 X |
| 5,236,054 | 8/1993 | Jack et al. | 175/57 |
| 5,273,124 | 12/1993 | Lloyd et al. | 175/162 |

*Primary Examiner*—Frank Tsay

*Attorney, Agent, or Firm*—Merchant, Gould, Smith, Edell, Welter & Schmidt, P.A.

[57] ABSTRACT

A direction boring machine is disclosed having elongated boom carried on a utility truck along which a drill head in longitudinally moved by a drive chain. The drill head is adapted to receive a plurality of drill stems, the outermost of which carries a drill bit. The boom is split at a predetermined longitudinal point to define first and second boom sections with the first boom section mounted on the utility truck. The second boom section is connected to the first boom section through a mechanical pivot that permits the second boom section to be pivoted between an operating position in which it is co-linear with the first boom section and a transport position in which the second boom section is upwardly pivoted or folded to overlie the first boom section. The mechanical pivot defines a pivot point between the boom sections that is disposed longitudinally inward of the boom split and above the longitudinal axis of the boom.

15 Claims, 4 Drawing Sheets

DIRECTIONAL BORING MACHINE

BACKGROUND OF THE INVENTION

The invention is broadly directed to directional boring machines and is specifically directed to an improved directional boring machine having a two-part boom section in which one part remains stationary and the other is rotated between transport and operating positions.

Directional boring machines are used to drill underground bores that generally run in a horizontal direction, and typically include an elongated boom that carries a drill head that moves longitudinally back and forth over the length of the boom. The boom mast is angled relative to the surface to be drilled at an angle ranging from 5 to 25 degrees. The drill head includes a rotating spindle, generally driven by a hydraulic motor, to which one or more elongated drill stems are detachably connected.

In operation, a first drill stem has one end connected to the rotating spindle of the drill head, and a drill bit is connected to the opposite end. With the drill head retracted to the inner end of the boom, spindle rotation begins and the head is advanced down the boom resulting in the drilling of a bore. When the drill head reaches the outer boom end, the drill stem is detached from the drill head spindle and the drill head is retracted to its original position. One end of a second drill stem is then mounted to the spindle with its opposite end connected to the existing drill stem. The drilling process then continues until the drill head again reaches the end of the boom, and the process is repeated.

The drill stems are typically hollow to permit the flow of a drilling lubricant that is discharged through the drill bit at the point of drilling. The drill stems are relatively rigid, and the bore that is being drilled initially extends in a straight direction at an inclined angle that corresponds to the angle of the boom. The angle of drilling may be altered so that, when a desired depth is reached, the drilling operation is changed to horizontal. When the underground bore is of the desired length, the drill bit can then be directed angularly upward until it re-emerges at ground surface. The position of the drill bit, both with respect to direction and depth, may be determined by an electronic transmitter located in the drill bit and an electronic receiver that is carried on the ground surface.

Generally speaking, the size of the machine varies as a direct function of the length of bore desired. Extremely large machines are capable of drilling underground in excess of 2,000 feet. Such machines typically have relatively long booms which may be of fixed length and carried in their entirety by the machine itself, or they may be telescopically extensible.

However, not all underground boring tasks are of this magnitude, and there is a significant need for a smaller machine that can be easily transported, set up and operated. Such smaller machines also require booms of some degree of length, but it is not practical or economically feasible to include a fixed length boom or one which is extensible.

The subject invention is directed to a directional boring machine of the smaller type which can be mounted on the bed of a utility truck. The inventive machine includes a two-piece or split boom having a first boom section mounted in a stationary position on the bed of a truck and a second boom section which is pivotally mounted in such a way that it can be folded to a transport position in which it is disposed over the first boom section and carried on the bed of the truck, and an operating position in which it is rotated into longitudinal co-linear alignment with the stationary boom section and into engagement with the ground.

The drill head of the inventive directional boring machine is longitudinally driven along the length of the boom by a length of chain, one end of which is pivotally connected to the rear side of the drill head, extending rearwardly therefrom and around a drive sprocket disposed at the inner end of the stationary boom section. The chain then extends forwardly under the boom for its entire length, reversing itself around an idler sprocket at the extreme outer end of the pivoted boom section and then being pivotally connected to the front side of the drill head. The drive sprocket is driven by a reversible hydraulic motor, the operation of which causes the drill head to move between retracted and extended positions along the boom.

This structural approach lends itself to a relatively small directional boring machine. However, the use of a drive chain of this type acts as an obstacle to the concept of pivoting one boom section relative to the other. Stated otherwise, the drive chain must be maintained in a taut condition at all times. When the outer boom section pivots upward it attempts to stretch the chain since the pivotal movement increases the effective length of the boom. However, the chain cannot be extended or flexed, and this effectively limits the distance the outer boom section from being pivotally rotated from its operating position.

This problem has been solved by dividing or splitting the two piece boom at a first longitudinal point so that the two boom sections are of equivalent length, and providing a mechanical linkage having a pivot point that is longitudinally inward from the dividing point of boom sections. As such, the chain has a pivot arm that is shorter than the pivot arm of the beam. As the outer boom section is pivoted upward, the drive chain becomes slack, and the outer boom section is capable of full pivotal movement to the transport position. In this position, the entirety of the boom rests on the bed of the truck, resulting in relatively simple transport without the concerns of a long projecting boom.

DESCRIPTION OF THE PREFERRED EMBODIMENTS

Figure 1:
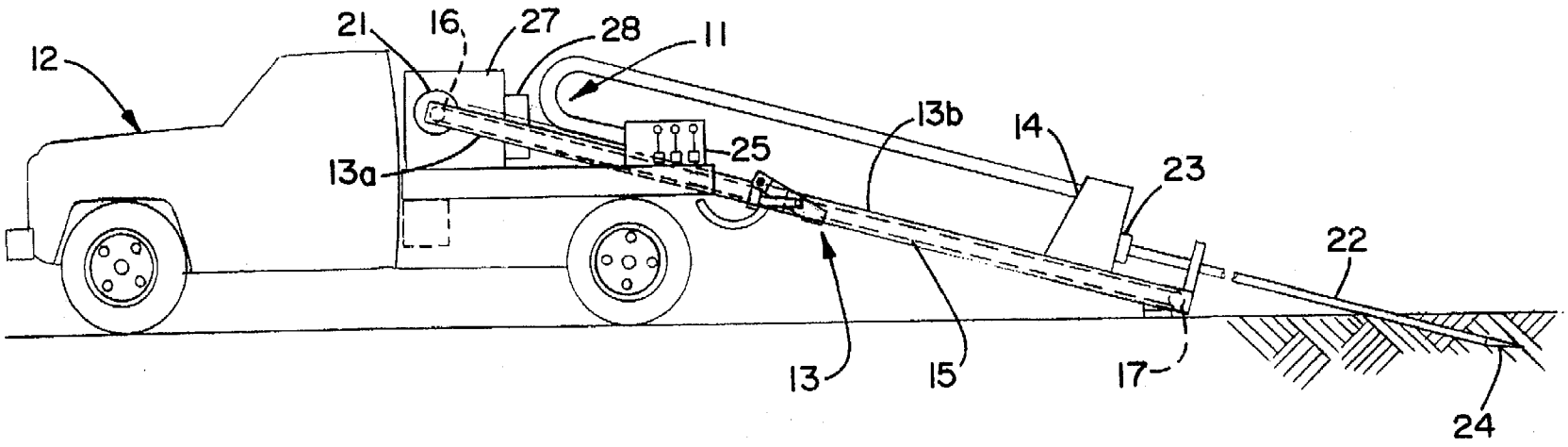
FIG. 1 is a simplified representation in side elevation of a truck-mounted directional boring machine having a pivoted boom which embodies the invention, with the pivoted boom extended into an operating position.

With initial reference to FIG. 1, a directional boring machine embodying the invention is represented generally by the numeral 11. Directional boring machine 11 is mounted on a movable carriage which in the preferred embodiment takes the form of a utility truck 12. In the overall range of sizes of directional boring machines, boring machine 11 is relatively small, and utility truck 12 may therefore specifically take the form of a small flat bed truck as is commonly used as a car wrecker/transport.

Boring machine 11 comprises an elongated boom 13 that specifically consists of an elongated stationary boom section and an outboard elongated movable boom section 13*b*. Boom sections 13*a*, 13*b* are of approximately equivalent length, and each has an inner or rearward end and an outer or forward end. As will be discussed in more specific detail below, boom section 13*b* may be upwardly pivoted or folded into a transport position as distinguished from the operating position of FIG. 1.

Boom section 13*a* is rigidly mounted to the bed of truck 12 at an angle that is declined from horizontal. This angle may vary and is typically in the range of 5 degrees to 25 degrees. In the operating position, outboard boom section 13*b* extends at the same angle and is substantially co-linear with boom section 13*a* with its inner end adjacent the outer end of boom section 13*a*.

Figure 2:
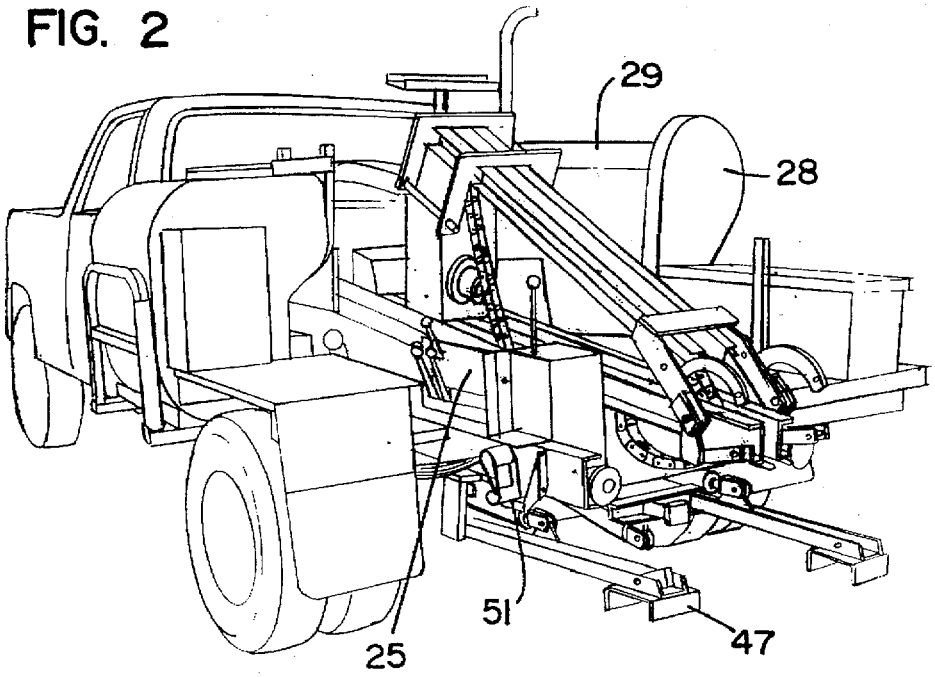
FIG. 2 is a perspective view of the directional boring machine as viewed from the rear and side of the machine with the pivoted boom folded to a transport position.
Figure 3:
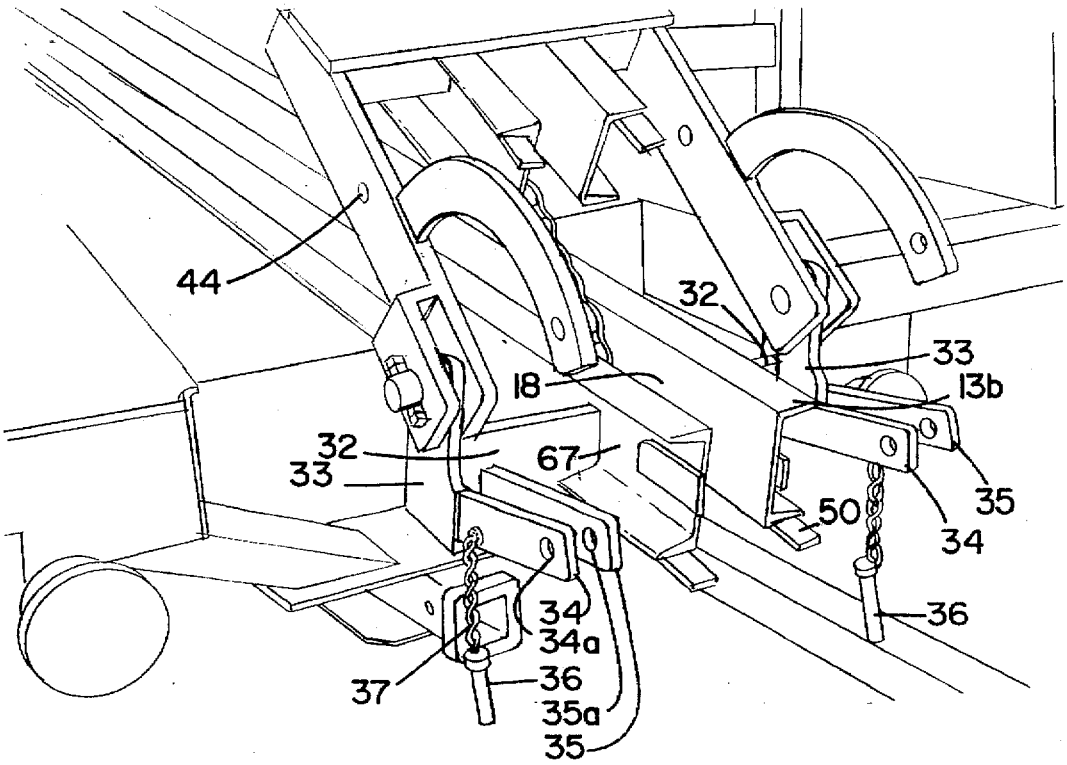
FIG. 3 is an enlarged fragmentary perspective view of the boom pivot mechanism with the boom in the transport position.
Figure 4:
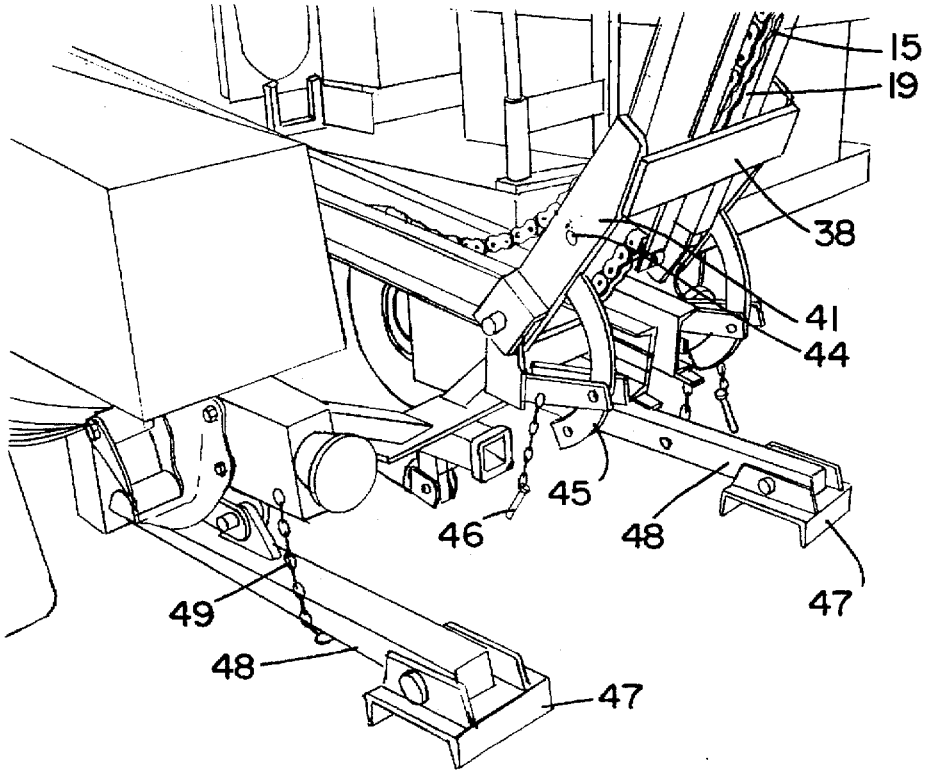
FIG. 4 is an enlarged fragmentary perspective view of the boom pivot mechanism with the boom in an intermediate position.
Figure 5:
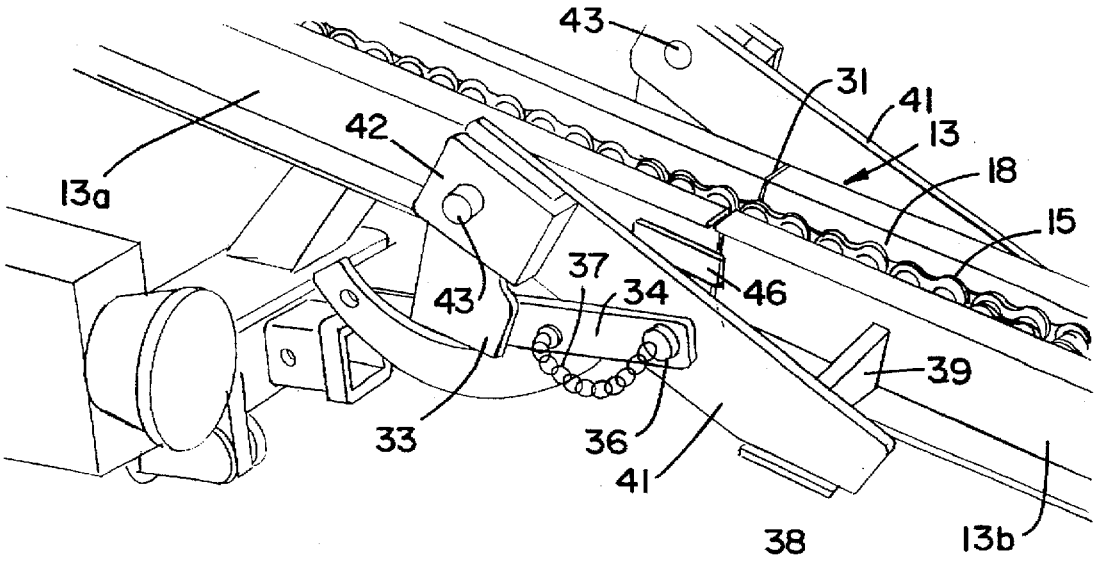
FIG. 5 is an enlarged fragmentary perspective view of the boom pivot mechanism with the boom in the extended or operating position.

In the preferred embodiment, each of the boom sections 13*a*, 13*b* takes the form of a double I-beam in which two identical I-beams are connected in spaced, side-by-side relation with top and bottom elongated channels 18, 19 disposed therebetween (see FIGS. 3 and 5). A drill head 14 is configured to slidably mate with boom 13 (see FIG. 2) permitting it to be longitudinally moved over a substantial portion of the length of boom 13. Such movement is accomplished by a two-ended chain 15 that extends around a drive sprocket 16 mounted at the inner end of boom section 13*a* and an idler sprocket 17 mounted at the extreme outer end of boom section 13*b*. As best shown in FIGS. 4 and 5, chain 15 rides in the elongated top and bottom channels 18, 19.

One end of chain 15 is pivotally connected to the rear side of drill head 14, and the other end is pivotally connected to the forward side of drill head 14. As drive sprocket 16 is reversibly driven, drill head 14 either slides rearward or forward in guided relation on boom 13 by claim 15.

Drive sprocket 16 is driven by a reversible hydraulic motor 21 that in turn is driven by a hydraulic pump (not shown). Since this is a relatively small directional boring machine, the engine of truck 12 drives this and other hydraulic pumps in a conventional manner through means not shown.

Drill head 14 also includes a hydraulic motor (not specifically shown) that drives a plurality of drill stems 22, one of which is shown in FIG. 1. Drill stems 22 are typically 10 and 20 feet in length, and the initial drill stem 22 is threadably secured to a rotatable spindle 23 on the drill head motor. A drill bit 24 is detachably mounted to the extreme end of the outermost drill stem 22. Drill bit 24 generally takes the form of a curved or tapered duck bill bit that bores a hole as drill stem 22 is rotated and drill head 14 is advanced by chain 15.

Drill bit 24 drills a straight bore as it is rotated. However, the direction of drill bit 24, and hence the direction of the resulting bore, may be changed by stopping the hydraulic motor in drill head 14 until the curved or tapered end of drill bit 24 points in the desired direction. The drill head 14 is then advanced on boom 13 a predetermined amount without rotation of the spindle 23 until the drill bit 24 changes direction due to its angle or curvature, at which time rotation of the spindle 23 and drill stems 22 begins again. Drill bit 24 thereafter bores a straight hole in the new direction until the direction is changed by the same process. The drill stems 22 are substantially rigid, but they have the capability of flexing and bending over the significant length of the bored hole.

When drill head 14 moves to its outermost position on boom 13 and directional boring cannot be further extended, the drill stem 22 which is connected to the spindle 23 is unscrewed, and the drill head 14 is withdrawn through reversed operation of the hydraulic motor 16 to its innermost or retracted position on boom 13. Unscrewing drill stem 22 from spindle 23 may be facilitated through the use of a hydraulic clamp at the end of boom section 13*b* (not shown), which holds the stem 22 while the spindle 23 is reverse driven. A new drill stem 22 is then screwed on to the spindle 23 and to the existing drill stems, and the process repeats.

The operation of the hydraulic motor 21 and the hydraulic motor in drill head 14 is controlled from a control station 25 at the back of truck 12 that includes appropriate manually operated hydraulic control valves. Hydraulic lines from control station 25 to drill head 14 are carried in a protective sheath 26.

In the preferred embodiment spindle 23 is hollow, as is each of the drill stems 22. A drilling lubricant, preferably taking the form of a slurry of Bentonite, is continuously supplied through drill stems 22 to the drill bit 24, which includes one more discharged outlets enabling the flow of lubricant at the point of drilling.

The Bentonite slurry is pumped to drill head 14 through a hydraulic line that also is carried within sheath 26. The source of the Bentonite slurry is a tank 27 mounted at the front and on one side of the bed of truck 12 (see FIG. 2). A pump 28 continuously pumps the Bentonite slurry to drilling head 14.

In larger directional boring machines, the entirety of the boom or mast in its elongated form is carried by the carriage or vehicle, and in some machines the boom itself is extensible. However, a relatively small directional boring machine cannot practically or economically include booms of this length or type, and the machine must be readily movable from one position to another without the problems associated with an elongated boom extending a significant distance from the bed of the truck. The directional boring machine 11 therefore is constructed to include pivotally connected separate boom sections 13*a*, 13*b*, the latter of which may be folded or pivoted upward from the operating position of FIG. 1 to the transport position of FIG. 2. However, while simply providing a pivotal mounting between the boom sections 13*a*, 13*b* appears to be a straightforward approach, this cannot be practically accomplished because the drill head drive chain 15 must be maintained in a taut condition at all times. In other words, while the chain is laterally flexible in order for it to follow the sprockets 16, 17, it is not flexible in the longitudinal sense, and chain tension effectively prevents the boom section 13*b* from being pivoted to any angular extent from its operating position.

This problem has been overcome by providing a mechanical pivoting mechanism that enables the boom sections 13*a*, 13*b* to be split or separated at a first longitudinal point while disposing the actual mechanical pivot point at a second point longitudinally inward from the first point.

Specifically, and with reference to FIGS. 2–5, boom 13 is divided or split without direct mechanical connection, as indicated by reference numeral 31 in FIG. 5. With specific reference to FIG. 3, a rigid bracket member 32 taking the form of a generally rectangular steel plate is welded to the outer face of stationary boom section 13*a* adjacent its end outer (i.e., just inward of the boom split 31), projecting laterally outward therefrom. A similar bracket member 32 projects from the opposite side of beam 13*b*, only a small portion of which may be seen in FIG. 3. An ear member 33 is welded to the outer end of each of the bracket members 32 and projects upward. A first guide member 34 is welded to the lower leading edge of ear member 33, projecting rearwardly and slightly upward. A second guide member 35 is welded to the front face of bracket member 32 in parallel relation to guide member 34. Aligned bores 34*a*, 35*a* are formed in the extreme end of guide members 34, 35. A retention pin 36 carried by a chain 37 mounted to guide member 34 may be inserted into the bores 34*a*, 35*a* as discussed below.

With continued reference to FIGS. 2–5, a boom support plate 38 is welded to the underside of boom section 13*b* at a point that is just outward or rearward of the boom split 31. Support plate 38 is also of rectangular configuration, and it laterally extends beyond each side of boom section 13*b*. A transverse support weldment 39 is welded to each side of beam 13*b* and is also welded to the top face of support plate 38 for additional support.

A pivot link 41 generally taking the form of an elongated rectangular steel plate is welded to boom support plate 38 and support weldment 39, projecting rearwardly beyond the boom split 31. Pivot link 41 also angles upward so that it terminates above the top surface of boom section 13*a* and immediately adjacent the associated ear member 33. Pivot link 41 also includes a shorter rigid rectangular plate 42 that is welded to the main body of pivot link 41 in parallel relation thereto, defining a recess into which the upper end of ear member 33 projects. The members 33, 41 and 42 are formed with aligned transverse bores that receive a pivot pin 43, which serves as the pivotal connection between boom sections 13*a*, 13*b*. It is essential that the pivot point between boom sections 13*a*, 13*b*, as defined by pivot pin 43, be disposed at a point that is longitudinally inward of the boom split 31, and for boom clearance purposes it is preferable that this pivot point be located above the top surfaces of boom sections 13*a*, 13*b*.

As best shown in FIG. 5, pivot link 41 is disposed to move between the guide members 34, 35. Further, it includes a transverse bore 44 intermediate its ends (see FIGS. 3 and 4) and when boom 13*b* is pivoted to the extended or operating position shown in FIG. 5 the bore 44 is in alignment with the bores 34*a*, 35*a* of guide members 34, 35, and pin 36 is inserted to retain boom section 13*b* in this position.

As best shown in FIGS. 3 and 4, an arcuate arm member 45 is welded to the bottom edge of each of the pivot links 41 and is disposed in the same plane. As such, each of the arcuate arm members is disposed between the guide members 34, 35 in guided relationship as the boom section 13*b* is pivoted or folded between operating and transport positions.

A retention tab member 46 is welded on each side face of boom section 13*a*, projecting slightly beyond its outer end. In this position, tab members 46 overlie the sides of the boom section 13*b* and prevent it from moving laterally relative to boom section 13*a* when in the operating position. A pair of retention tab members 50 are also welded on each side of the bottom of boom section 13*a*, projecting beyond its outer end. The tab members 50 overlie the bottom of boom section 13*b* and prevent it from moving downward relative to boom section 13*a* in the operating position.

With reference to FIGS. 2 and 4, boring machine 11 also includes a pair of stabilizer pads 47 that are pivotally carried by a pair of extension arms 48, which in turn are pivotally connected to the underside of the bed of truck 12. A chain 49 carried by the truck chassis can be detachably connected to the extension arm 48 to hold it in an elevated position during transport. A hydraulic cylinder 51 (FIG. 2) carried by the truck frame is pivotally connected to each of the extension arms 48, enabling each of the extension pads 47 to engage the ground in a stabilizing manner in the operating position.

In operation, with the boom section 13*b* folded to the transport position shown in FIG. 2, utility truck 12 is transported to the position in which an underground bore is to be drilled. When the truck 12 is properly positioned, boom section 13*b* is lifted from the transport position shown in FIGS. 2 and 3, and is pivoted upward about the pivot pins 43. At the intermediate position shown in FIG. 4, arcuate guide arm members 45 project between the guide members 34, 35, ensuring that further movement of the boom section 13*b* is in alignment with the boom section 13*a*. The boom section 13*b* then reaches the operating position shown in FIG. 5, at which point transverse bore 44 of pivot link 41 is in alignment with the aligned bores 34*a*, 35*a*, and the tension pin 36 is inserted. In this position, boom section 13*b* is in longitudinal alignment with boom section 13*a*, and retention tab members 46, 50 retain the boom sections in alignment.

Chains 49 are then released from extension arms 48 and stabilizing pads 47 are lowered by the hydraulic cylinders 51 until they supportably engage the underlying surface.

The boring operation then begins as described in detail above, with progressive drilling movement of drill head 14 along boom 13 and the continued addition of drill stems 22 until an underground bore of desired length is accomplished. Upon completion retention pins 36 are removed, and boom section 13*b* is pivotally lifted until it is in the folded or transport position. Stabilizing pads 47 are then lifted or retracted to the transport position and retained by chains 49.

It will be appreciated that locating the pivot point between boom sections 13*a* and 13*b* at a point that is longitudinally inward from the boom split 31 enables boom section 13*b* to be pivoted upward because it provides a pivot arm for the chain 15 that is shorter than the pivot arm of the boom 13, which corresponds to the length of boom section 13*a*. Stated otherwise, locating the boom split 31 at a point that is longitudinally outward of the pivot pin 43 permits chain 15 to immediately loosen as boom section 13*b* is pivoted upward. If the pivot pin 43 were located so that its rotational axis passed through the boom split 31, the tautness of chain 15 would increase as boom section 13*b* was lifted and would ultimately prevent further upward movement.

Figure 6:
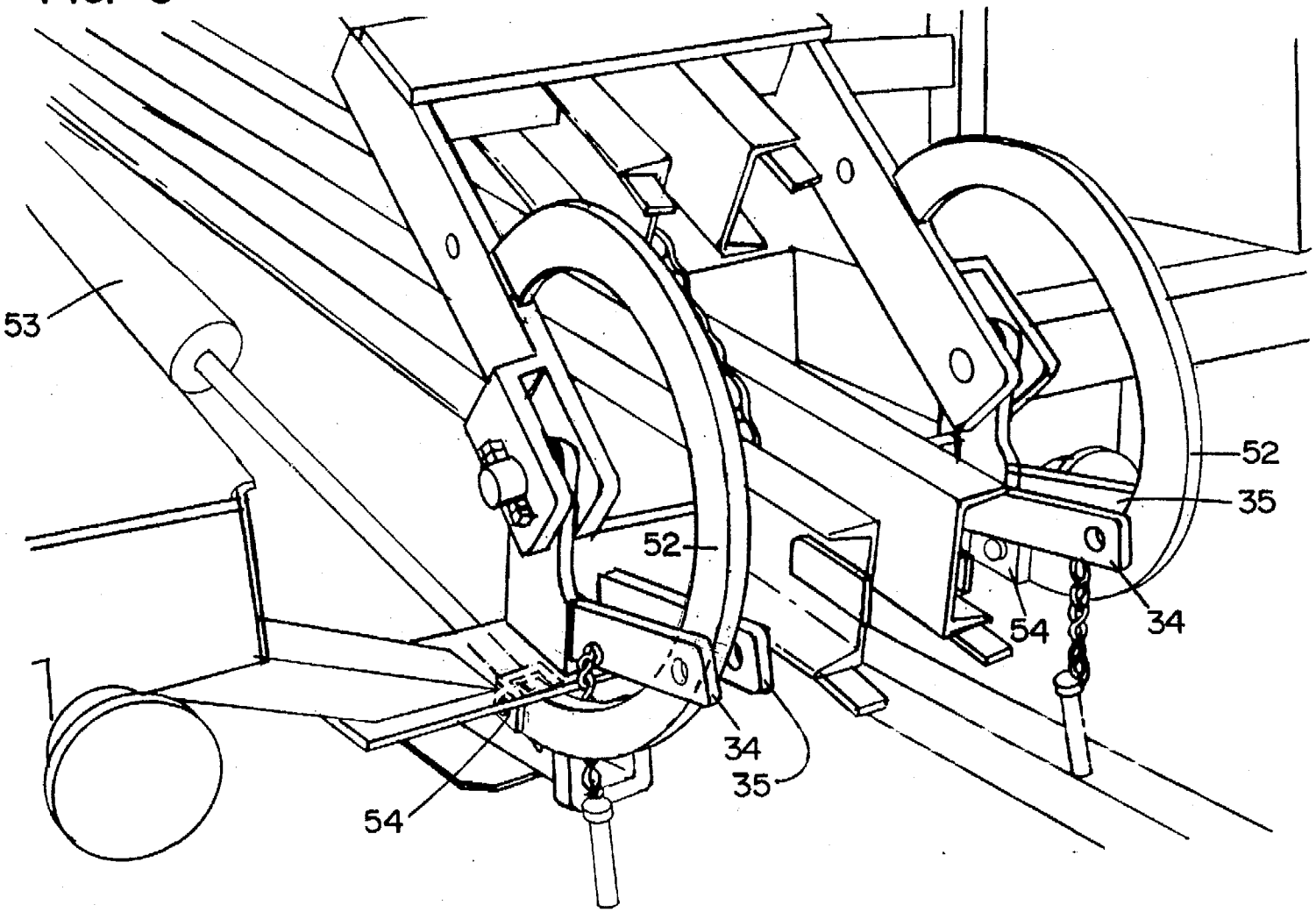
FIG. 6 is an enlarged fragmentary perspective view of an alternative embodiment of the boom pivot mechanism.

The boom section 13*b* is manually moved between transport and operating positions in the embodiment of FIGS. 1–5. Because of the inherent weight of boom section 13*b*, drill head 14 and the associated structure, this manual movement generally requires two workers. FIG. 6 is an alternative embodiment that includes hydraulic actuators to perform the task of moving boom 13 between transport and operating positions.

In FIG. 6, like components with the embodiment of FIGS. 1–5 carry like reference numerals. The principal difference resides in the provision of arm members 52 that have a longer arcuate length than the counterpart arm members 45. In addition, a hydraulic actuator 53 is pivotally connected to the truck frame at an inward point not shown, and its actuator rod is pivotally connected to the end of arm member 52 by a clevis and pin 54. As shown, the extension rod of actuator 53 is fully extended so that boom section 13*b* is rotated or folded to the transport position. If the extension rod of actuator 53 is retracted, boom section 13*b* is rotated outward until it reaches the operating position. All operation of the directional boring machine is otherwise the same.

What is claimed is:

1. A directional boring machine comprising:

carriage means;

elongated boom means carried by the carriage means at a predetermined angle relative to the surface to be bored;

drill head means mounted on the boom means for longitudinal movement thereover, the drill head means comprising rotatable spindle means adapted to receive and rotatably drive at least one drill stem;

said boom means comprising first and second elongated boom sections each having inner and outer ends, the first boom section being mounted on said carriage means;

and boom connecting means for mounting the second boom section to the first boom section for pivotal movement between an operating position in which the second boom section extends substantially co-linearly from the first boom section with the inner end of the second boom section adjacent the outer end of the first boom section, and a transport position in which the second boom section is pivotally rotated to overlie the first boom section;

the boom connecting means defining a connecting pivot point that is disposed longitudinally inward of the outer end of the first boom section.

2. A directional boring machine comprising:

carriage means;

elongated boom means carried by the carriage means at a predetermined angle relative to the surface to be bored;

drill head means mounted on the boom means for longitudinal movement thereover, the drill head means comprising rotatable spindle means adapted to receive and rotatably drive at least one drill stem;

said boom means being split at a predetermined longitudinal point to define first and second boom sections with said first boom section mounted on said carriage means;

and boom connecting means for connecting said second boom section to said first boom section for pivotal movement between an operating position in which the second boom section extends substantially co-linearly from the first boom section, and a transport position in which the second boom section overlies the first boom section, the boom connecting means defining a pivot point that is disposed longitudinally inward of said predetermined longitudinal point.

3. The direction boring machine defined by claim 2, wherein said pivot point is disposed above the longitudinal axis of the first boom section.

4. The direction boring machine defined by claim 2, which further comprises drive means for longitudinally moving the drill head means on said boom means between extended and retracted positions.

5. The direction boring machine defined by claim 4, wherein the drive means comprises a drive chain having a first end connected to the rearward side of the drill head means and a second end connected to the forward side of the drill head means, said drive chain being looped around drive sprocket means rotatably mounted on one of said boom sections and idler sprocket means mounted on the other of said boom sections.

6. The directional boring machine defined by claim 2, wherein the boom connecting means comprises:

pivot link means carried by the second boom section proximate said boom split and projecting toward said pivot point;

bracket means carried by said first boom section proximate said predetermined longitudinal point and defining said pivot point;

and pivot pin means pivotally connecting said pivot link means and said bracket means at said pivot point.

7. The directional boring machine defined by claim 6, which further comprises a support plate secured to the underside of the second boom section proximate the boom split and extending laterally outward of the second boom section on each side thereof, and the pivot link means comprises first and second pivot links respectively secured to the support plate on each side of said second boom section.

8. The directional boring machine defined by claim 7, wherein the bracket means comprises:

first and second bracket members projecting laterally outward of the first boom section on opposed sides thereof;

first and second ear members respectively connected to the first and second bracket members, each of said ear members defining a pivot point with said pivot points disposed in co-linear relation;

and said pivot pin means comprises first and second pivot pins respectively connecting the first and second links and the first and second ear members.

9. The directional boring machine defined by claim 8, wherein said first and second ear members project above the top surface of the first boom section, and the pivot points of said first and second ear members are disposed above the top surface of the first boom section.

10. The directional boring machine defined by claim 9, which further comprises first and second arcuate arms respectively carried by the first and second pivot links and respectively projecting toward said first and second bracket members;

and first and second guide means respectively carried by the first and second bracket members for guiding the first and second arcuate arms as the second boom section is pivotally moved between the operating and transport positions.

11. The directional boring machine defined by claim 10, which further comprises actuating means carried by the carriage means and connected to each of said arcuate arms for moving the second boom section between the operating and transport positions.

12. The directional boring machine defined by claim 2, which further comprises retention means for retaining the second boom section in said operating position.

13. The directional boring machine defined by claim 12, wherein the retention means comprises a plurality of retention tab means carried by one of the first and second boom sections and projecting toward the other for preventing relative lateral movement therebetween.

14. The directional boring machine defined by claim 12, wherein the retention means comprises removable retention pin means associated with the boom connecting means for interlocking the first and second boom sections in said operating position.

15. The directional boring machine defined by claim 2, which further comprises actuating means for pivotally moving the second boom section between the operating and transporting positions.

* * * * *